US005208634A

United States Patent [19]

Ikemoto et al.

[11] Patent Number: 5,208,634

[45] Date of Patent: May 4, 1993

[54] PROCESS CARTRIDGE DETACHABLY MOUNTABLE TO IMAGE FORMING APPARATUS FEATURING AN INJECTABLE SEALING MEMBER

[75] Inventors: Isao Ikemoto; Tadayuki Tsuda, both of Kawasaki; Kazushi Watanabe, Yokohama; Kazuhiko Ishiwata, Tokyo; Kazuo Shishido; Kanji Yano, both of Kawasaki; Makoto Tanaka, Tokyo; Shinichi Sasaki, Fujisawa; Toshiyuki Karakama; Hiroyuki Shirai, both of Tokyo, all of Japan

[73] Assignee: Canon Kabushiki Kaisha, Tokyo, Japan

[21] Appl. No.: 689,517

[22] Filed: Apr. 23, 1991

[30] Foreign Application Priority Data

Apr. 27, 1990 [JP] Japan ..... 2-110613
Mar. 19, 1991 [JP] Japan ..... 3-54446

[51] Int. Cl.[5] ..... G03G 15/00

[52] U.S. Cl. ..... 355/215; 355/211; 355/245

[58] Field of Search ..... 355/211, 215, 245, 296, 298

[56] References Cited

U.S. PATENT DOCUMENTS 4,785,319 11/1988 Fujino et al. ..... 346/160
4,851,960 7/1989 Nakamura et al. ..... 361/225
4,938,381 7/1990 Mandeville et al. ..... 425/4 C X
5,021,830 6/1991 Koiso ..... 355/215
5,060,014 10/1991 Adachi et al. ..... 355/211

FOREIGN PATENT DOCUMENTS 58-63961 4/1983 Japan ..... 355/215
59-155877 9/1984 Japan ..... 355/215
62-192768 8/1987 Japan ..... 355/215

OTHER PUBLICATIONS

"Gaskets for Xerographic Developer", IBM-Technical Disclosure Bulletin, Vol. 28, No. 8, Jan. 1986

"Developer Unit Incorporating Liquid Sealant," IBM-Technical Disclosure Bulletin, Buckely, Patent Abstracts of Japan, Vol. 5, No. 154 (P-82) Sept. 29, 1981 JP 56087068.

*Primary Examiner*—Joan H. Pendegrass
*Attorney, Agent, or Firm*—Fitzpatrick, Cella, Harper & Scinto

[57] ABSTRACT

A process cartridge detachably mountable to an image forming apparatus includes a device contributable for forming an image; a developer accommodator; and a sealing member between the image forming device and the developer accommodator, wherein the sealing member is provided by injecting a liquid material which becomes an elastomer when it is solidified.

30 Claims, 12 Drawing Sheets

PROCESS CARTRIDGE DETACHABLY MOUNTABLE TO IMAGE FORMING APPARATUS FEATURING AN INJECTABLE SEALING MEMBER

FIELD OF THE INVENTION AND RELATED ART

The present invention relates to a process cartridge detachably mountable to an image forming apparatus such as an electrophotographic copying machine, a laser beam printer or another electrophotographic printer or the like, and more particularly to a process cartridge having a developer container containing powdery developer.

Such an image forming apparatus of a process cartridge type is known wherein some means contributable to image formation are contained as a unit in a cartridge, which is replaceable as a whole upon the end of the service life of such means with the advantage of good maintenance.

Referring to FIG. 1, an example of such a process cartridge will be described. The exemplary process cartridge 1 includes an image bearing member in the form of a photosensitive drum 2 and process means disposed therearound, the process means including a cleaning device 3, a developing device 4 and a charging device 5. They are contained in a frame 1*a* of the cartridge as a unit. The photosensitive drum is protected by protection covers 6*a*, 6*b* and 6*c*. The covers 6*a*, 6*b* and 6*c* covers a pre-exposure opening, an image exposure opening and image transfer opening, respectively.

The cleaning device 3 has a cleaning blade 30 actable on the photosensitive drum 2 and a receptor sheet, and a residual toner accommodator 32 constituted by a blade holder 30*a*, a cleaning container 3*a* and the cartridge frame 1*a*. The developing device 4 comprises a developing sleeve 40 facing the photosensitive drum 2, a developer layer regulating blade 41 and a toner accommodator constituted by a developer container 4*a* and a toner container 4*b*.

As for the cleaning device 3, in order to prevent the leakage of the residual toner through the connection portions between the cleaning container 3*a*, blade holder 3*a* and the cartridge frame 1*a* of the residual toner accommodator 32, a fixed-shape sealing member 102 made of rubber, such as Moltplane (trade name), is provided. In order to prevent leakage through the clearance between ends of the photosensitive drum 2 and the residual toner accommodator 32, a fixed-shape sealing member made of rubber such as Moltplane (trade name) or the like is provided between the cleaning blade 30, the photosensitive drum 2 and the receptor sheet 31.

As for the developing device, in order to prevent the leakage of the toner through a connecting portion between the developer container 4*a* and the toner accommodator 4*b*, both of the containers are fused together at the portions 43' and 43'. In addition, to prevent the leakage of the toner through the clearance between the ends of the developing sleeve 40 and the toner container 42, a sealing member 101 made of felt or the like is provided at the outer peripheral portion at the toner accommodator 42 side of the developing sleeve 40.

Therefore, although the process cartridge has the advantage of easy replacement by users, particular attention is required to the leakage of the toner by the provisions of sealing members at various portions.

However, the sealing member 100 in sliding contact with the photosensitive drum 2 and the cleaning member 101 in sliding contact with the developing sleeve 40 are so designed on the basis of the prediction of the maximum clearances A1 and A2 between the photosensitive drum 2 and the residual toner accommodator 32 and between the developing sleeve 40 and the toner accommodator 42, or the like. It follows that a variation in the clearance due to unavoidable manufacturing tolerances in the process cartridge results in variations in the pressing force applied by the sealing members 100 and 101 to the photosensitive drum 2 and the developing sleeve 40. This results in the disadvantage that the torque required for the rotation of the photosensitive drum 2 and the developing sleeve 40 is not constant.

In addition, mounting of the sealing members 100 and 101 is time consuming, and it is difficult to use automatic assembling in this case. Additionally, small clearances can remain during the manufacturing process between the sealing member 100 and the photosensitive drum 2 and between the sealing member 101 and the developing sleeve 40. It is difficult to discover such clearances, and therefore, it is not until the process cartridge 1 is put into use and there is toner leakage that the clearance is discovered.

The same situation applies to the sealing member 102. The conventional sealing member 102, as shown in FIG. 2, for example, comprises plural sealing members 102*a*, 102*b*, 102*c* and 102*d*. It is difficult to use automatic assembling techniques for mounting all of the sealing members 102*a*, 102*b*, 102*c* and 102*d* without clearance over the entire circumference of the connecting portion among the cleaning container 3*a*, blade holder 3*a* and the cartridge frame 1*a* which constitute the residual toner accommodator 32. If a slight clearance is produced adjacent the sealing members, it is difficult to discover the clearances. Similarly, it is not until toner leakage is experienced upon the mounting or dismounting of the process cartridge relative to the main assembly that the toner leakage is discovered.

Even if the sealing member 102 is in the form of a unit single sealing member, it is still difficult to mount it at the correct position over its entirety because the sealing member is flexible. In addition, the usage of the material is not efficient if the unit sealing member is stamped out of the base material sheet.

Conventionally, the developer container 4*a* and the toner accommodator container 4*b* are fused together at the positions 43 and 43' to constitute the toner accommodator 42. This is not advantageous from the standpoint of reuse of the resources and environment protection or the like. More particularly, when the parts are collected back and reused, the fused connection has to be broken when the process cartridge is disassembled or cleaned.

SUMMARY OF THE INVENTION

Accordingly, it is a principal object of the present invention to provide a process cartridge wherein the leakage of the developer therefrom is assuredly prevented.

It is another object of the present invention to provide a process cartridge having a developing sealing member which makes the process cartridge assembling operation easier.

It is a further object of the present invention to provide a process cartridge having a developer sealing member easily matching complicated configurations.

The invention which achieves these objectives, according to one aspect, relates to a process cartridge detachably mountable to a main assembly of an image forming apparatus for forming an image on a recording material using a developer, comprising means for forming an image, a developer accommodator, and a sealing member between the image forming means and the developer accommodator, the sealing member being provided by injecting a liquid material which becomes an elastomer when it is solidified.

In accordance with another aspect of the present invention, the present invention relates to a process cartridge detachably mountable to a main assembly of an image forming apparatus for forming an image on a recording material using a developer comprising a developer accommodator comprising a plurality of connected members and a sealing member provided at a connecting portion between the plurality of members, the sealing member being provided by injecting a liquid material which becomes an elastomer when it is solidified.

In accordance with still another aspect, the present invention which achieves these objectives relates to a process cartridge detachably mountable to a main assembly of an image forming apparatus for forming an image on a recording material using a developer comprising an image bearing member, process means actable on the image bearing member, a developer accomodator, and a sealing member for preventing leakage of the developer from the developer accommodator, the sealing member being provided by injecting a liquid material which becomes an elastomer when it is solidified.

In accordance with still another aspect, the present invention relates to a process cartridge detachable mountable to a main assembly of an image forming apparatus for forming an image on a recording material using a developer, comprising process means, developer accommodating means for accommodating the developer, a cartridge frame for containing the process means and the developer accommodating means, and a sealing member for preventing leakage of the developer from the cartridge, the sealing member being an elastic member provided by solidification of liquid material.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described.

Figure 3:
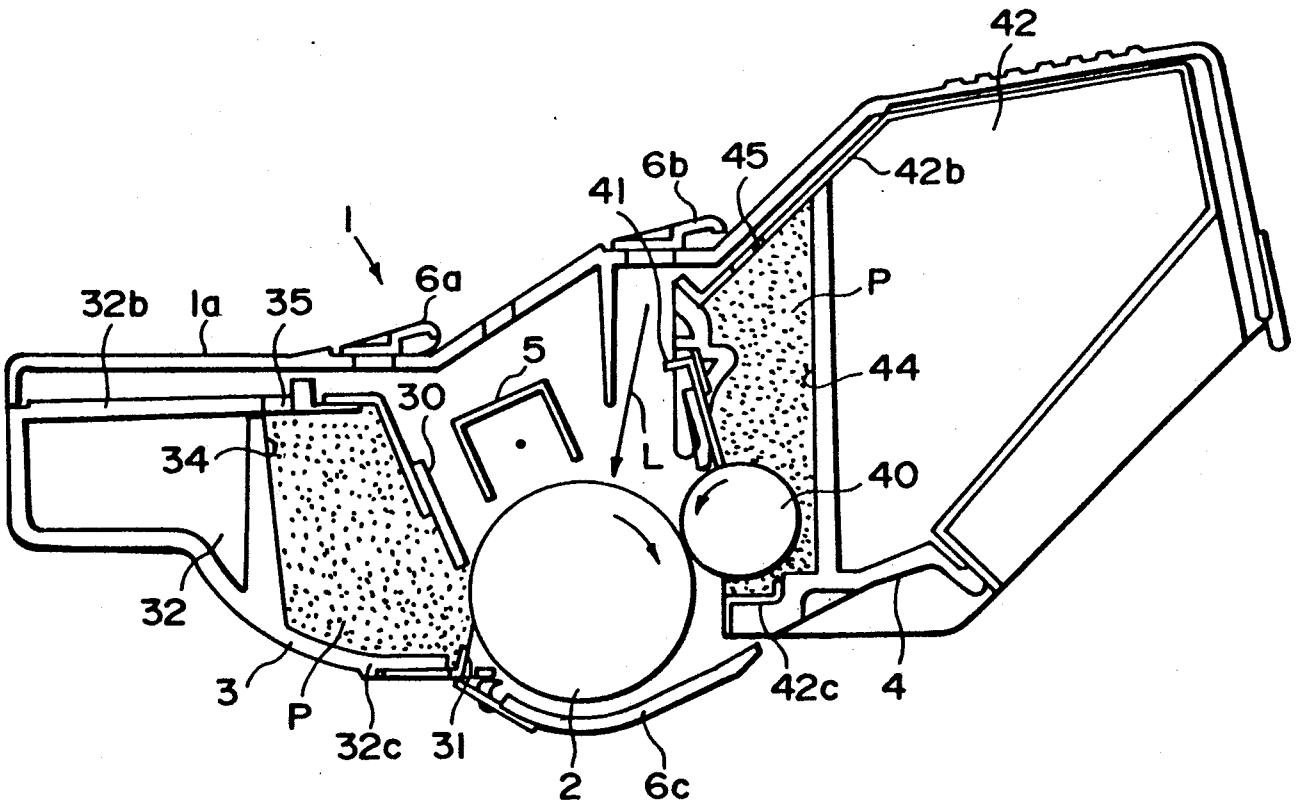
FIG. 3 is a sectional view of a process cartridge according to a first embodiment of the present invention.

Referring to FIG. 3, there is shown a process cartridge according to a first embodiment of the present invention. The process cartridge comprises a cartridge frame 1*a* which contains a photosensitive drum 2 (image bearing member) and process means including a cleaning device 3, a developing device 4 and a charging device 5. They are constituted as a unit, as shown in U.S. Pat. No. 4,785,319. When the service life of the photosensitive drum 2 and/or the developing device 4 comes to the end, or when the cleaning device 3 becomes filled with residual toner, or when the toner in the developing device 4 is used up, or the like, the entire process cartridge is replaced with a fresh process cartridge. By doing so, maintenance operations are made easier. In this embodiment, the charging device 5 is in the form of a well-known corona charger, but it may be in the form of a discharging device disclosed in U.S. Pat. No. 4,851,960.

The cleaning device 3 comprises a cleaning blade 30 for removing the residual toner (residual developer) from the photosensitive drum and a receptor sheet 31 for receiving the removed toner without leaking it to the outside, and a residual toner accommodator 32 for accommodating the residual toner therein, or the like. The developing device 4 comprises a developing sleeve 40 rotatable in a predetermined direction to supply the toner (developer) carried thereon to the photosensitive drum 2, a regulating blade 41 for regulating the thickness of a layer of the toner on the developing sleeve 40 and a toner accommodator 42 for accommodating the toner and supplying it to the developing sleeve 40, and the like.

In the process cartridge constructed in the manner described above, the photosensitive drum 2 is uniformly charged by the charging device 5 and is exposed to image light L corresponding to the image signals, so that an electrostatic latent image is formed on the photosensitive drum 2. The electrostatic latent image is brought by the rotation of the photosensitive drum 2 to the developing device 4, where the latent image is developed by the developing device 4 with the toner supplied from the developing sleeve 40 into a visualized toner image. The toner image is then transferred onto a transfer material through an unshown transfer charger or the like, and the photosensitive drum 2, after the image has been transferred therefrom, is cleaned by a cleaning blade 30 which contacts the photosensitive drum 2 to remove the residual toner. Then, the photosensitive member 2 is prepared for the next image formation. The residual toner removed by the cleaning blade 30 is stored in the residual toner accommodator 32 of the cleaning device 3 by the receptor sheet 31 in contact with the photosensitive drum 2.

Figure 4:
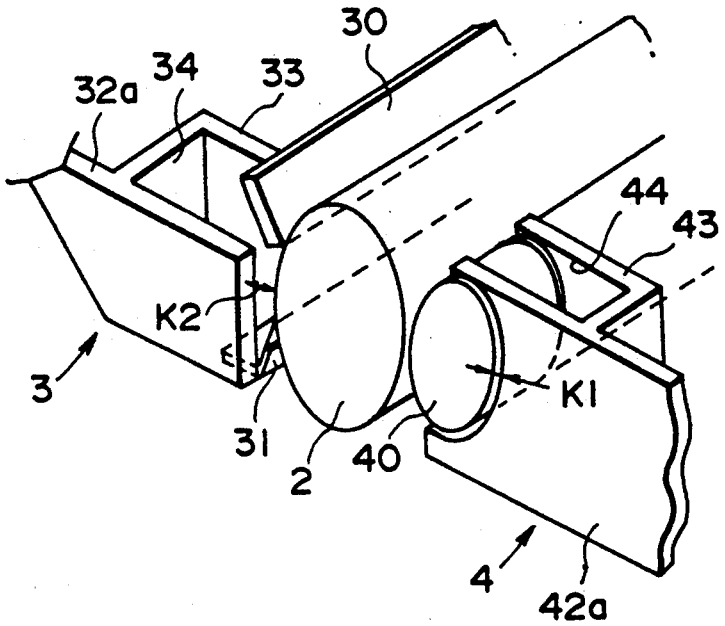
FIG. 4 is a perspective view of a longitudinal end portion of the photosensitive drum of FIG. 3.

Referring to FIG. 4, each of the longitudinal ends of the developing sleeve 40 of the developing sleeve 4 penetrates through a side wall 42*a* of the toner accommodator 42, and the developing sleeve 40 is rotatably supported by the toner accommodator 42. There is a small clearance K1 between the developing sleeve 40 and the side wall 42*a* of the toner accommodator 42, and therefore, it is necessary to prevent leakage of the toner through the clearance K1 to the outside.

Figure 1:
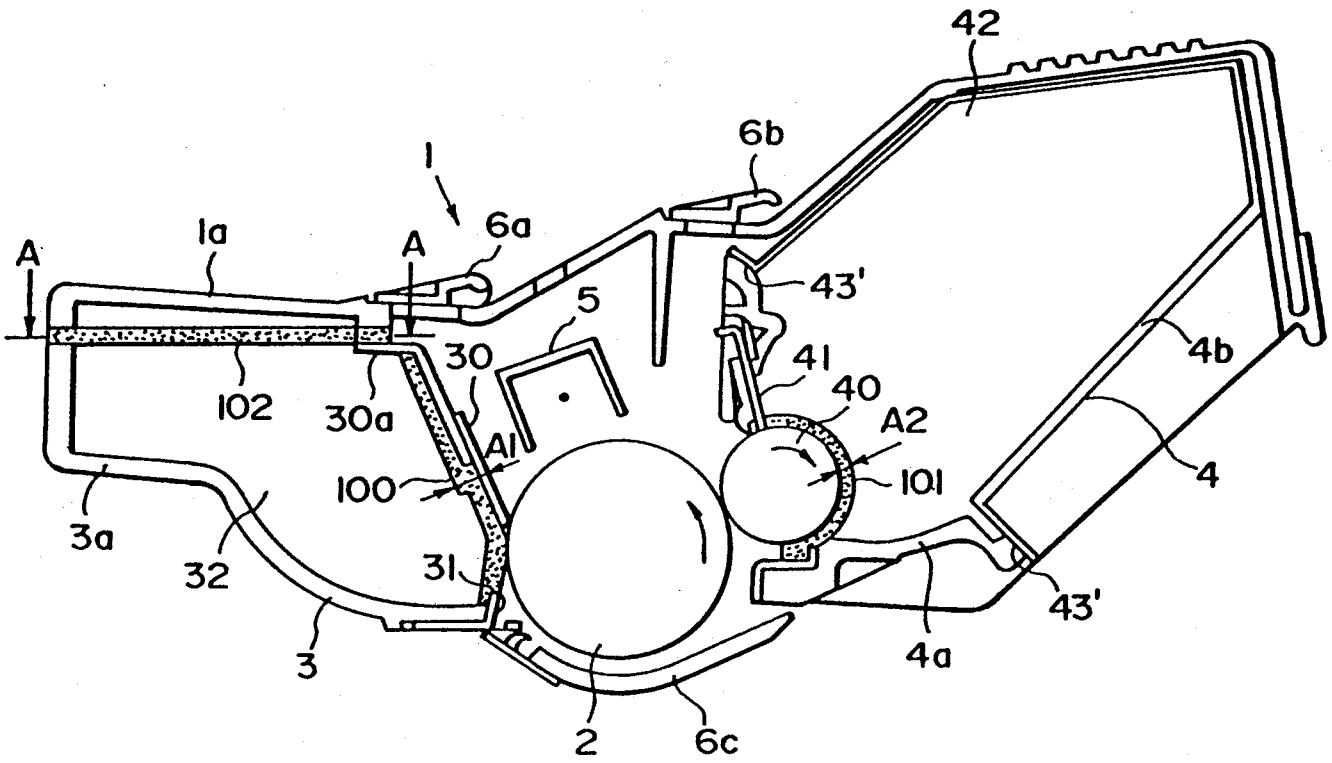
FIG. 1 PRIOR ART
FIG. 1 is a sectional view illustrating a conventional sealing member in a process cartridge.
Figure 2:
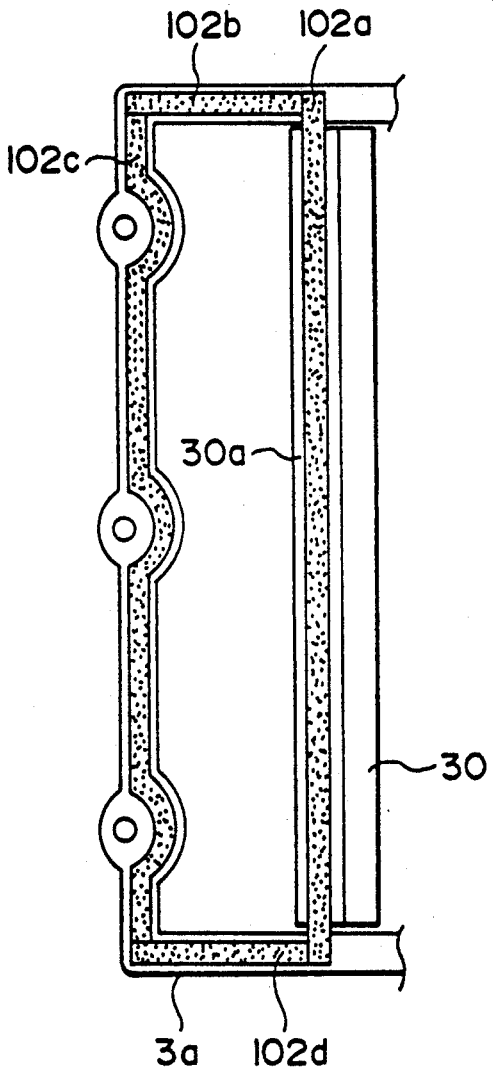
FIG. 2 PRIOR ART
FIG. 2 is a sectional view taking along line A/A in FIG. 1.

In this embodiment, the side wall 42*a* has a double wall structure 42 having a U-shaped cross-section around and above the developing sleeve 40, thus defining a sealing space 44 by the developing sleeve 40, the regulating blade 41, and the top and bottom walls 42*b* and 42*c* (FIG. 1) of the toner accommodator 42. The sealing space 44 is thus formed around the developing sleeve 40. The sealing space 44 is provided at each of the longitudinal ends of the developing sleeve 40.

Figure 5:
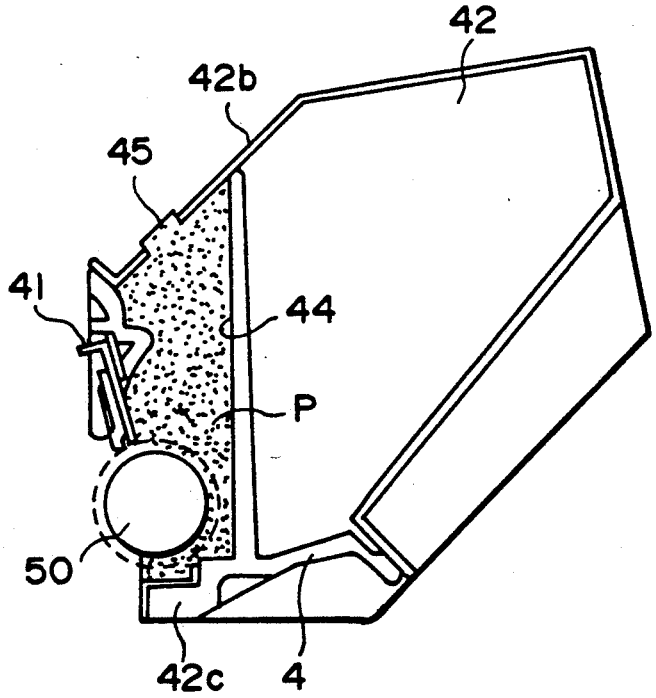
FIG. 5 is a partial sectional view of the developing device wherein the sealing member is injected with a cylindrical tool in place of the developing sleeve.

As shown in FIG. 5, a sealing material P of two-pack urethane rubber liquid is injected directly into the sealing space 44 through an opening 45 formed in the top wall 42*b* of the toner accommodator 42. Since the sealing material P is foaming material, it is solidified while foaming in the sealing space 44 in approximately 30 sec.–10 min. after the injection, into an elastomer (sealing member) having elasticity which fuse the sealing space 44. The sealing member, therefore, functions as the sealing member. The stickiness of the surface of the sealing material P disappears 3–10 min. after the foaming, and therefore, the rotation of the developing sleeve 40 is not obstructed even if it occurs around the developing sleeve 40. Thus, the sealing member is provided by the liquid material becoming solidified as an elastomer injected in the sealing space 44 to seal the clearance between the developing sleeve 40 and the toner accommodator 42. Therefore, the sealing is assured without difficulty. Since the sealing member does not have at first any fixed shape, proper sealing is provided even if the developing device 4 involves some manufacturing deviation within the tolerance. The developing sleeve 40 is therefore substantially free from variations in the rotational torque attributable to the variations in pressure by the sealing member on the developing sleeve 40 due to a manufacturing error.

It will be understood that the sealing is easily effected irrespective of the configuration of the members defining the sealing space around the developing sleeve 40, and therefore, the configuration of the developing sleeve 4 can be freely selected, and the size of the developing device 4 can be reduced.

As shown in FIG. 5, in order to enhance the sealing effect of the sealing member P, a cylindrical tool 50 having a diameter slightly smaller than the developing sleeve 40 is used in place of the developing sleeve 40, and the sealing material P is injected into the sealing space 44 defined by the periphery of the cylindrical tool 50. After the sealing material is solidified, the cylindrical tool 50 is replaced with the developing sleeve. By doing so, the sealing member P is pressed by the developing sleeve 40 at the periphery thereof, and therefore, the pressing force by the sealing member P to the developing sleeve 40 is increased, so that the sealing effect is enhanced.

Figure 6:
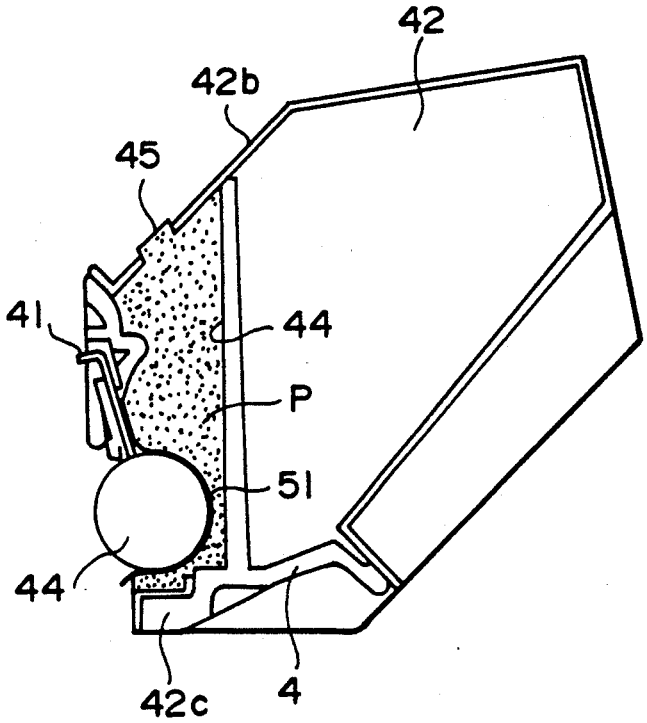
FIG. 6 is a partial sectional view of the developing device wherein the developing sleeve is covered with a film having a good sliding property, and thereafter, the sealing member is injected.

As shown in FIG. 6, a Teflon film or polyethylene film or the like 51 having a good sliding nature may be fixed on the toner accommodator 42 side to cover the periphery of the developing sleeve 40 at the sealing member side, and the sealing material P may be injected into the sealing space 44 defined thereby. By doing so, the developing sleeve 40 and the sealing member P do not directly contact each other, so that the friction therebetween can be decreased.

In the case of the cleaning device 3, the cleaning blade 30 and the receptor sheet 30 contact the photosensitive drum, and the top and bottom portions are sufficiently sealed. However, as shown in FIG. 4, there is a small clearance K2 between each of the longitudinal ends of the photosensitive drum 2 and the side wall 32*a* of the residual toner accommodator 32 of the cleaning device 3. Therefore, some measure against leakage of the residual toner through the clearance K2 is required.

In a similar manner to the developing device 4, the photosensitive drum 2 side of the side wall 32*a* of the residual toner accommodator 32 of the cleaning device is formed into a double wall 33 structure having a U-shaped configuration. A sealing space 34 is defined by the double wall 33, the receptor sheet 31, the photosensitive drum 2, the cleaning blade 30 and the top and bottom walls 32*b* and 32*c* of the residual toner accommodator 32. In a similar manner to the developing device 4, the sealing material P is injected into the sealing space 34 through an opening 35 (FIG. 3) to prevent the leakage of the residual toner at the opposite ends of the cleaning device 3.

As described in the foregoing, the sealing for the developing device 4 and the cleaning device 3 in the process cartridge 1 is effected by an elastomer provided by the solidification of liquid material such as foaming polyurethane rubber or the like. Therefore, the toner sealing is assuredly accomplished in the process cartridge 1 without difficulty, and the rotational torque required for a rotatable member such as the photosensitive drum 2 or the developing sleeve 40 can be maintained constant.

Figure 7:
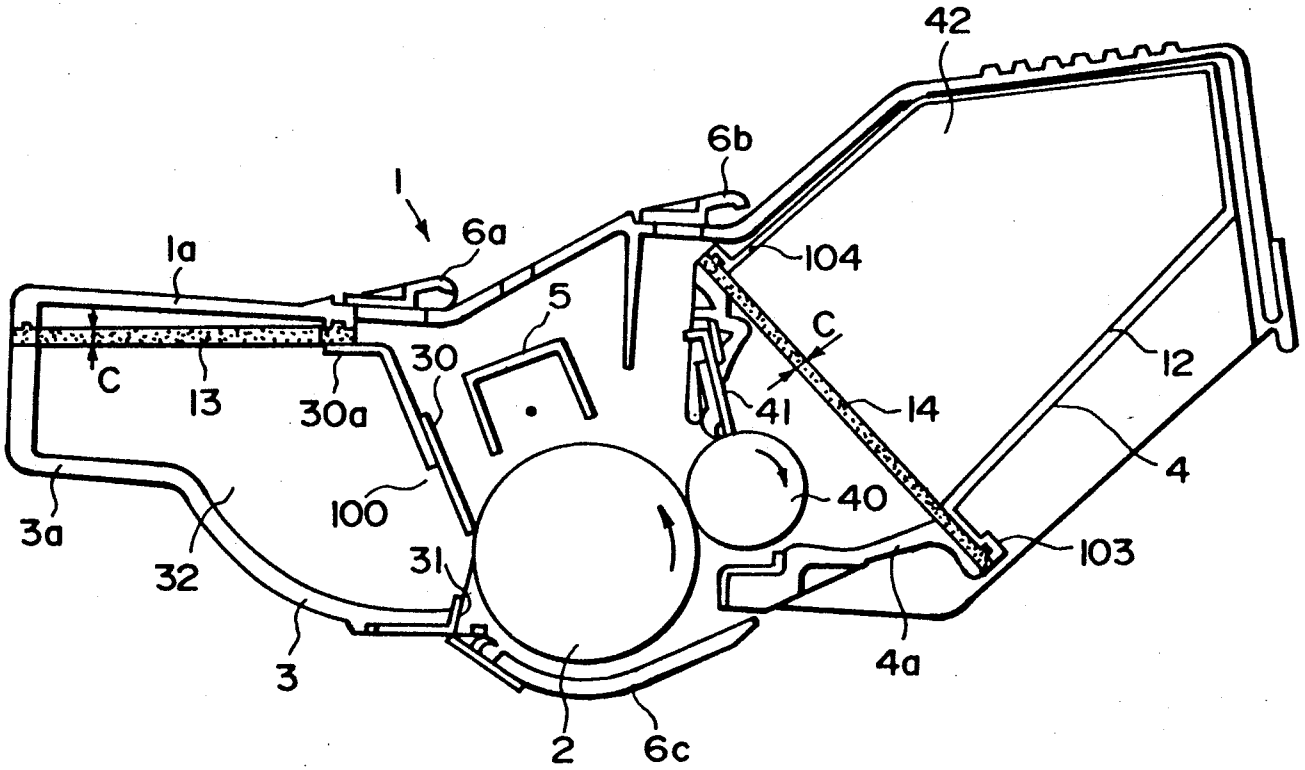
FIG. 7 is a sectional view of a process cartridge according to a second embodiment of the present invention.
Figure 8:
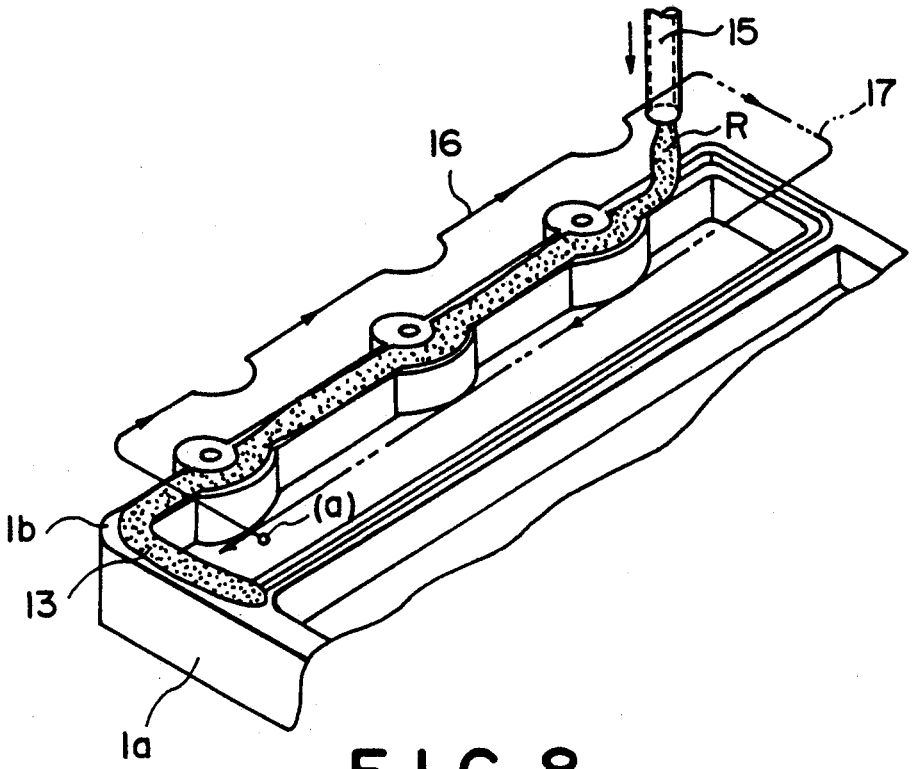
FIG. 8 is a partial perspective view wherein a liquid material is being injected into the connecting portion of the cartridge frame of FIG. 7.
Figure 9:
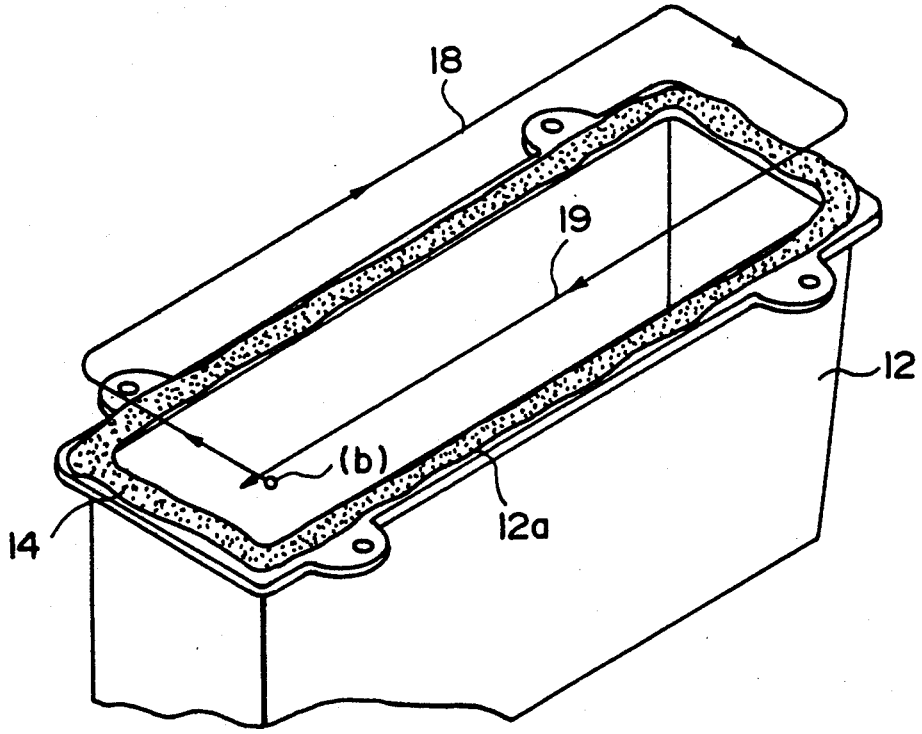
FIG. 9 is a perspective view wherein the liquid material has been injected into the connecting portion of the toner container.

Referring to FIGS. 7, 8 and 9, a process cartridge according to a second embodiment of the present invention will be described. As shown in FIG. 7, the toner accommodator 42 comprises a toner container 12 and a developer container 4*a* coupled by screws or the like with a sealing member 14 therebetween to permit easy disassembling and cleaning. The sealing member 14 is effective to prevent leakage of the toner through the coupling portion therebetween. The residual toner accommodator 32 is constituted by a cleaning container 3*a* and a blade holder 30*a* coupled through a cartridge frame 1*a* and the sealing member 13. The sealing member 13 functions to prevent leakage of the toner through the coupling portion.

Referring to FIGS. 8 and 9, the sealing members 13 and 14 will be described in further detail. The sealing member in this embodiment is provided by directly injecting through a nozzle 15 a material R comprising two-pack urethane rubber to the connecting surface 1b (FIG. 8) of the cartridge frame 1a and to the connecting surface 12a (FIG. 9) of the toner container 12. The material R is a foaming material, and it foams and solidifies on the connecting surfaces 1b and 12a in approximately 30 sec.–10 min. after the ejection, into an elastomer having elasticity.

Figure 10:
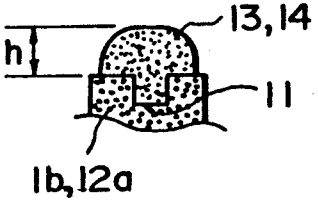
FIG. 10 is a partial sectional view wherein the liquid material has been injected into the connecting portion.

Referring to FIGS. 8 and 9, the passage of injection of the sealing materials 13 and 14 will be described. The injection passage of the material R starts at the position a in FIG. 18 and extends along arrows 16 and 17 to return to the original position a, thus foaming a closed loop. Similarly, in FIG. 9, the sealing material 14 extends from a position b along arrows 18 and 19 to return to the original position b. The surface receiving the injection, that is, the connecting surfaces 1b (FIG. 8) and 12a (FIG. 9) have preformed grooves 11 as shown in FIG. 10, and therefore, the material R (sealing member) flows without difficulty in the grooves 11, and is solidified into a elastomer having elasticity. Therefore, the sealing material and the sealing member do not easily come off, or are not easily positioned out of place. The cartridge frame 1a and toner accommodating container 12 are connected with the cleaning container 3a and the developer container 4a while the solidified sealing members 13 and 14 are on the cartridge frame 1a and the toner container 12. Thus, the sealing members 13 and 14 are effective to prevent the leakage. The height (FIG. 10) of the solidified and elastic elastomers 13 and 14 is larger than the clearance C (FIG. 7) after they are coupled, and therefore, it is pressed to a height equal to the clearance C, thus sufficiently filling the clearance.

In this embodiment of the present invention, an automatic operation is possible in consideration of the material to be injected, the injection passage, the injection speed and the injection rate, so that the sealing member can be formed along the connecting surfaces with certainty and without difficulty. The complicated passage shown in FIG. 8 does not cause inconveniences. The injection control will be described hereinafter.

Since the sealing member is provided by solidifying a liquid material such as the foaming polyurethane rubber or the like on the connecting portion among plural parts constituting the developing device 4, the toner accommodator 42 and the residual toner accommodator 32 of the cleaning device 3 in the process cartridge, a toner seal is easily accomplished at the connecting portion of the container having a complicated structure. In addition, a closed loop for the injection passage can be easily formed, so that the leakage of the toner through the connections between plural sealing members, which has been a problem in conventional devices, can be prevented.

Figure 11:
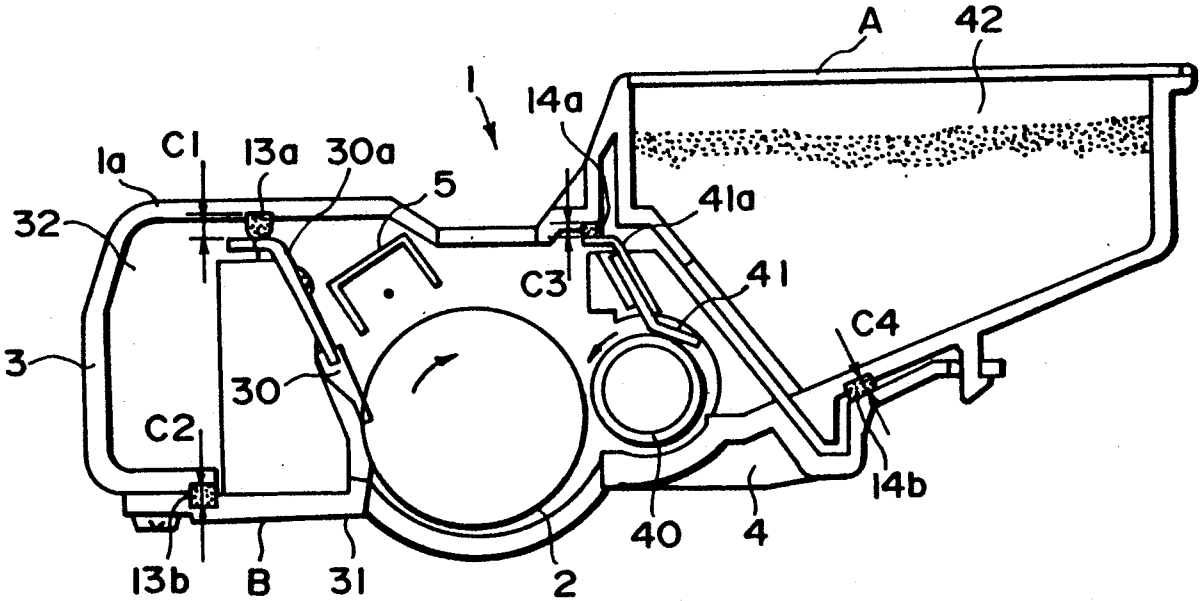
FIG. 11 is a sectional view of a process cartridge according to a third embodiment of the present invention.
Figure 12:
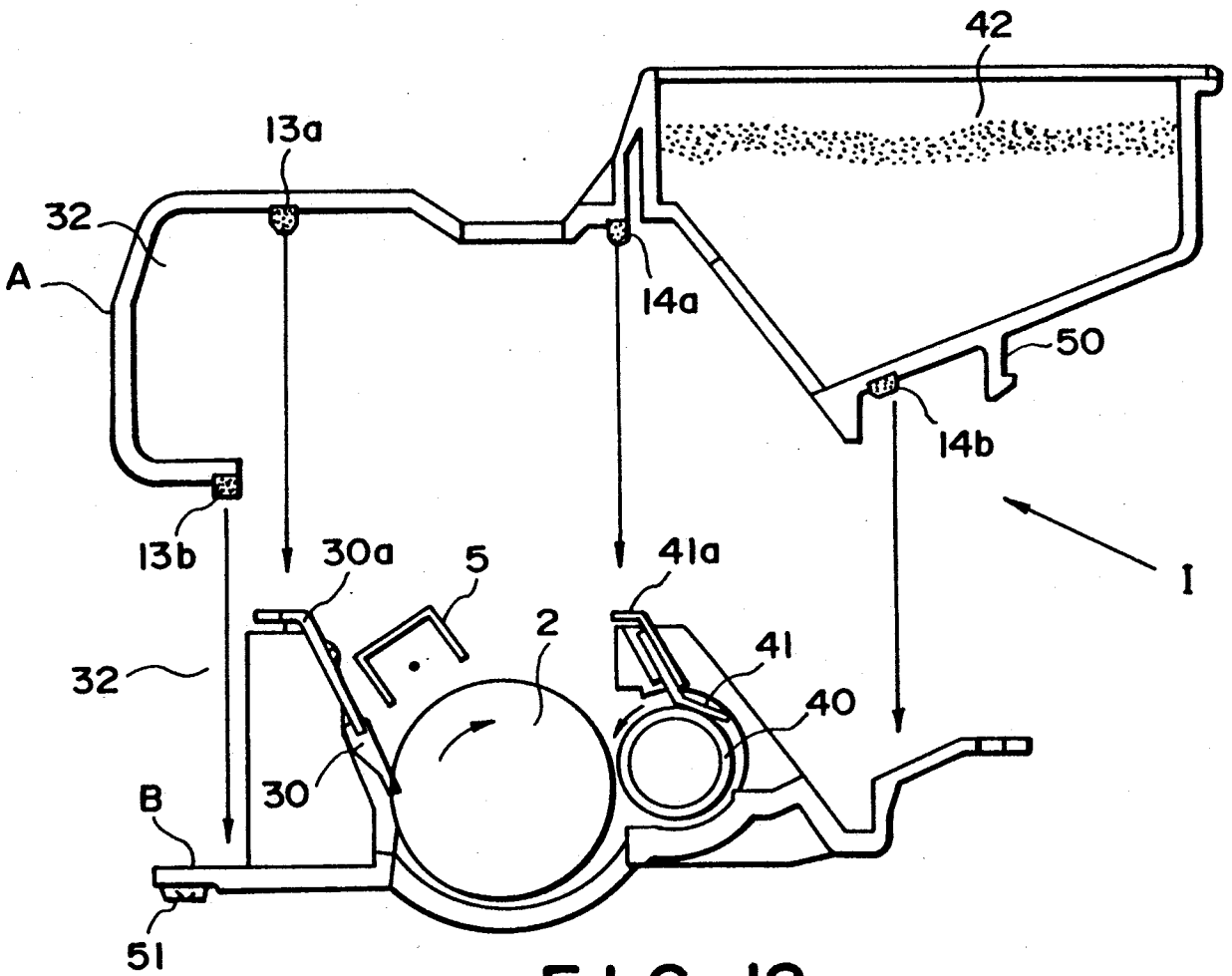
FIG. 12 is a sectional view wherein the process cartridge shown in FIG. 11 is separated into an upper frame and the lower frame.
Figure 13:
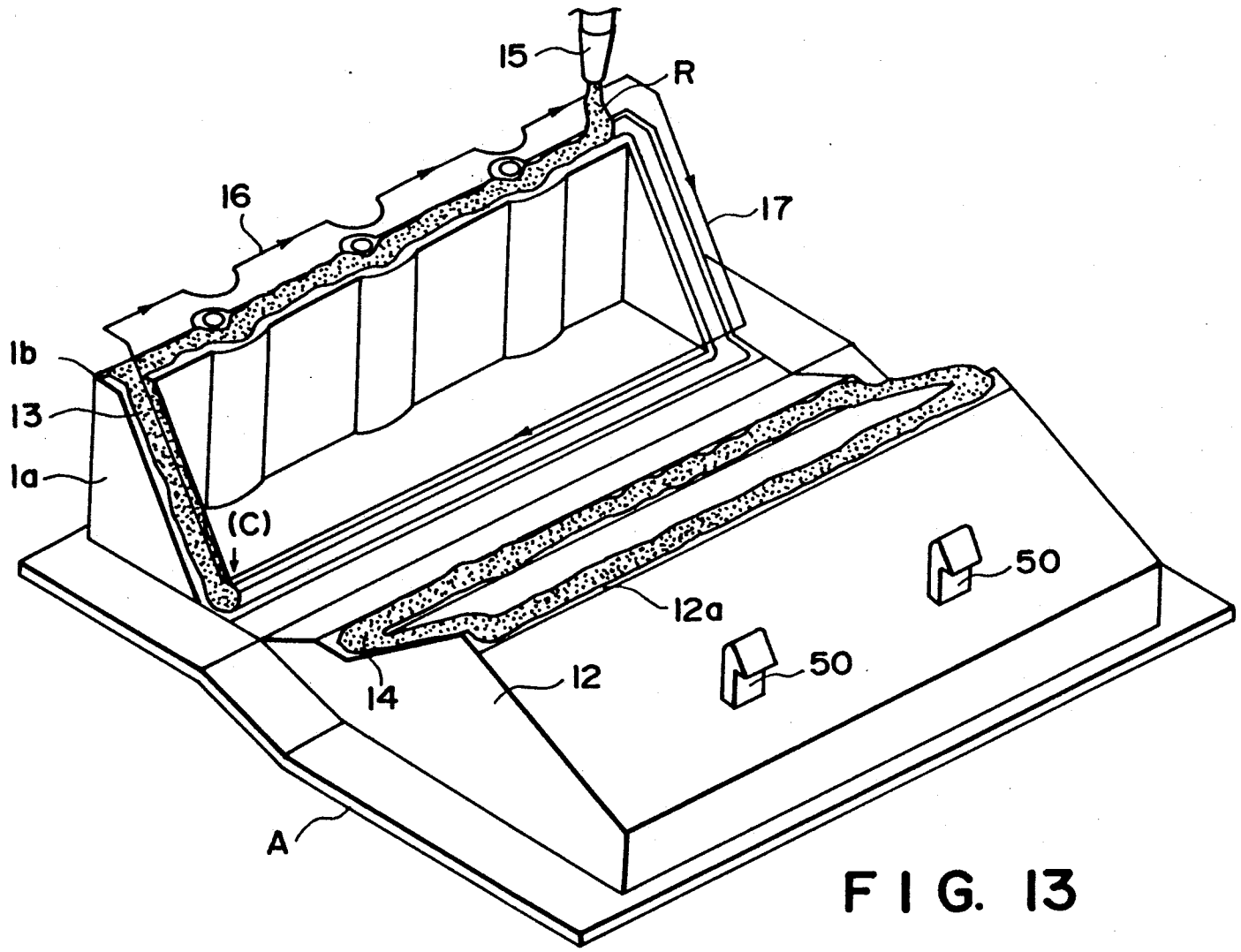
FIG. 13 is a perspective view when the liquid material is injected to the connecting portion of the top frame.

Referring to FIGS. 11, 12 and 13, a description will be provided as a process cartridge according to a third embodiment of the present invention. The same reference numerals as in the first and second embodiments are assigned to the elements having corresponding functions.

As shown in FIG. 12, the process cartridge of FIG. 11 has a top frame A and a bottom frame B connected by pawls 50 and screws 51. The top and bottom frames A and B sandwich sealing members 13b and 14b. The toner accommodator 42 of the developing device is constituted by coupling the top and bottom frames A and B and the blade holder 41a connecting the top frame A and the regulating blade 41. The connecting portion between the top frame A and the regulating blade holder 41a is provided with a sealing member 14a to prevent toner leakage therethrough. The residual toner accommodator 32 of the cleaning device 3 is constituted by coupling the top and bottom frames A and B and the cleaning blade holder 30a connecting the top frame A and the cleaning blade 30. The connecting portion between the top frame A and the cleaning blade holder 30a is provided with a sealing member 13a to prevent the toner leakage therethrough.

FIG. 13 shows a view of an inside of the top frame A of FIG. 12, as seen in the direction I. As best seen in FIG. 13, the material R comprising two-pack urethane rubber is directly injected through the nozzle 15 to the top and bottom frame connecting surfaces constituting the toner accommodator and the residual toner accommodator. Since the material is a foaming material, it foams and solidifies on the connecting surfaces 1b and 12a approximately 30 sec.–10 min. after the injection, into an elastomer having elasticity.

The injection passage of the material R starts at a position c and extends along arrows 16 and 17 to return to the original position c, thus constituting a closed loop. The connecting surfaces 1b and 12a have preformed grooves, and therefore, the material R flows without difficulty into the groove, and thereafter, it becomes the elastic elastomer. Therefore, the sealing member does not easily come off or slip off. The top frame A is coupled with the bottom frame B while the sealing members 13 and 14 are solidified on the frame A, and therefore, the sealing members 13 and 14 function to prevent the leakage of the toner from the toner accommodator and the residual toner accommodator. The height (FIG. 10) of the solidified sealing members 13 and 14 having the elasticity is larger than the clearances C1, C2, C3 and C4 (FIG. 11) after the coupling, and therefore, the sealing members are pressed to the clearances C1–C4, thus sufficiently filling the clearance.

In a similar manner to the foregoing embodiment, an automatic operation is possible in consideration of the injection passage, the injection speed of the material R and the injection rate of the material, so that the sealing is accomplished without difficulty but with certainty. In addition, the injection port can be positioned on to one frame A, and therefore, the injection is possible after one positioning of the frames, and therefore, the number of operation steps can be significantly decreased.

In the, first, second and third embodiments, the liquid material going to be solidified into an elastomer is injected into the sealing space or the connecting portion.

Figure 14:
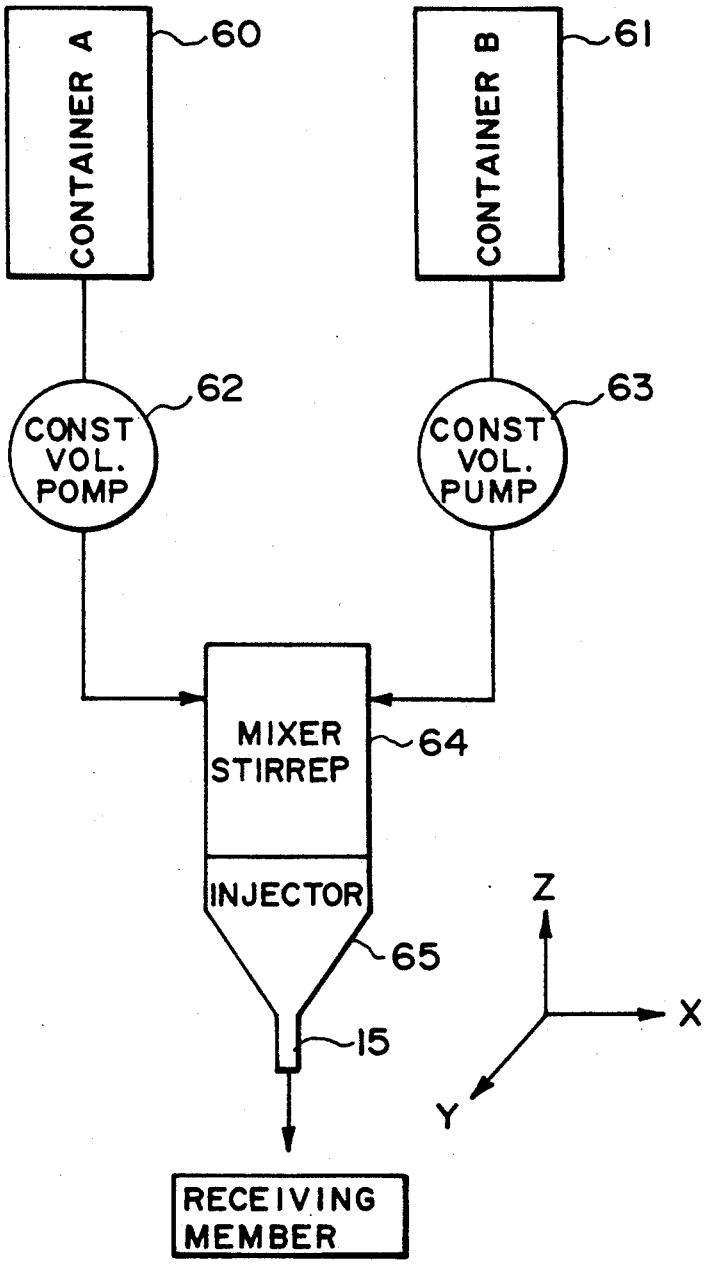
FIGS. 14 and 15 illustrate a liquid material injection system.

Referring to FIG. 14, a description will be provided as to a system for mixing the two-pack reactive liquid and injecting the mixture from the nozzle 15. Accurate metering pumps 62 and 63 supply liquid A and liquid B from containers A60 and B61 to a mixing and stirring device 64 to provide proper mixture ratio for the reaction therebetween. At the mixing and stirring position 64, a motor forcedly stirs the mixture to provide uniform mixture of the liquid A and the liquid B. It requires at least 30 sec. for the liquid A and the liquid B to react and solidify into an elastic elastomer, and therefore, the mixture is ejected through a nozzle 15 of an ejector 65 in the form of a liquid, halfway through the reaction. The injection head constituted by the mixing and stirring device 64, the ejector 65 and the nozzle 15 moves in three axes directions X, Y and Z, following the configuration of the receiving member such as the container, and inject the liquid material thereto.

The mixture ratio of the liquid A and the liquid B by the metering pumps 62 and 63, the mixing and stirring speed, the traveling passages of the injection head in the X, Y and Z directions, and the injection speed or the like are controlled properly in accordance with the program in a controller of an unshown industrial robot. In accordance with such control, the injecting operation is carried out automatically.

Figure 15:
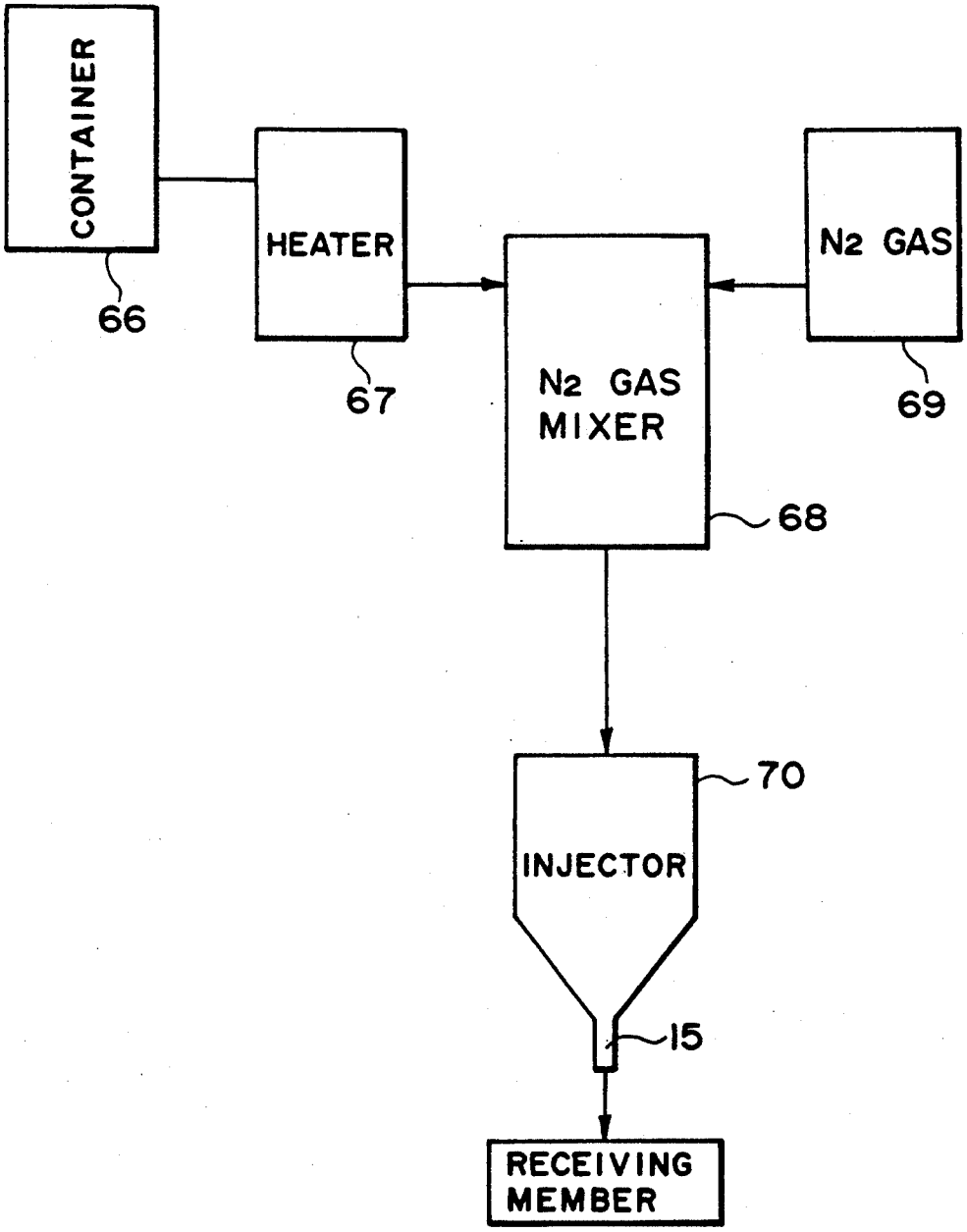

Referring to FIG. 15, a description will be provided as to the case wherein one-pack reactive liquid in place of the two-pack reactive liquid is used as the liquid material. In this case, $N_2$ gas is mixed into the liquid to forcedly foam the material, and the material is ejected through the nozzle 15. In FIG. 15, the liquid material mainly comprising polyurethane resin is heated by a heater 67 to 70° C.–100° C. It is supplied from a container 66 by a pump to a foaming and mixing machine 68, in which the liquid supplied from the container 66 is reacted and foamed by the mixture with $N_2$ gas. Before the liquid material is solidified, it is ejected through the nozzle 15 of the ejector 70 to the receiving member.

In a similar manner to that described above, the mixture of $N_2$ gas, the supply of the material, the traveling passage of the injection head in the X, Y and Z directions and the injection speed or the like is properly controlled by the controller of an unshown industrial robot, so that the injection operation is carried out automatically.

Thus, the one-pack reactive liquid can be used for the liquid material in the present invention. The elastomer in this embodiment preferably has an elongation of 100–200%, a hardness (Asker C) 4–15 degrees, and a compression restoration of not less than 90% to perform the sealing functions in good order.

In the foregoing embodiments, the sealing member is an elastomer of a foaming material. However, another elastomer such as soft rubber or soft plastic material is usable in place thereof.

In the first, second, and third embodiments, the process cartridge has the residual toner accommodator of the cleaning means and the toner accommodator of the developing means. However, the present invention is applicable to the case of at least one of them contained in the process cartridge.

In FIG. 3, the sealing between each of the longitudinal end portions of the developing sleeve and the toner accommodator of the developing device and the sealing between each of the longitudinal ends of the photosensitive drum and the residual toner accommodator of the cleaning device, are accomplished by injecting liquid material which becomes an elastomer by being solidified. This may be utilized in the process cartridge shown in FIG. 7 or 11.

As described, according to the present invention, liquid material is injected and solidified at the position where sealing is required against the leakage of the developer in the process cartridge, by which the sealing member is provided by the solidified elastomer having elasticity. Therefore, the leakage of the developer can be assuredly and easily prevented, as compared with the conventional sealing method. In addition, sealing is easy even if the portion to be sealed has a complicated configuration. Since automatic control of the liquid material injection is possible, the assembling of the process cartridge becomes easier.

In this specification, "solidification" covers the case where the material is not completely solidified but is partly solidified to a sufficient extent to effect the proper sealing in the above described manner.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to a main assembly of an image forming apparatus for forming an image on a recording material using a developer, comprising:

means for forming an image;

a developer accommodator; and a sealing member formed on a connecting surface between said image forming means and said developer accommodator, wherein said sealing member is provided by injecting into a groove formed in the connecting surface a liquid material which becomes an elastomer when it is solidified.

2. A cartridge according to claim 1, wherein said image forming means is a developing roller.

3. A cartridge according to claim 2, wherein a film is provided between said developing roller and said elastomer.

4. A cartridge according to claim 1, wherein said image forming means are an image bearing drum and cleaning member.

5. A cartridge according to any one of claim 1, 2, 3 and 4, wherein said elastomer is foaming material.

6. A process cartridge detachably mountable to a main assembly of an image forming apparatus for forming an image on a recording material using a developer, comprising:

a developer accommodator comprising a plurality of connected members; and a sealing member provided at a connecting portion between the plurality of members, wherein said sealing member is provided by injecting into a groove formed in the connecting portion a liquid material which becomes an elastomer when it is solidified.

7. A cartridge according to claim 6, wherein said developer accommodator is provided in developing means.

8. A cartridge according to claim 6, wherein said developer accommodator is provided in cleaning means.

9. A cartridge according to any one of claim 6–8, further comprising an image bearing member.

10. A process cartridge detachably mountable to a main assembly of an image forming apparatus for forming an image on a recording material using a developer, comprising:

an image bearing member;

process means actable on said image bearing member;

a developer accommodator; and a sealing member forming on a connection surface between said image bearing member and said developer accommodator for preventing leakage of developer from said developer accommodator, wherein said sealing member is provided by injecting into a groove formed in the connection surface a liquid material which becomes an elastomer when it is solidified.

11. A cartridge according to claim 10, wherein said process means includes at least one of charging means, developing means and cleaning means.

12. A process cartridge detachably mountable to a main assembly of an image forming apparatus for forming an image on a recording material using a developer, comprising:

process means;

developer accommodating means for accommodating the developer;

a cartridge frame for containing said process means and said developer accommodating means; and a sealing member formed on a connection surface of said cartridge frame for preventing leakage of the developer from said cartridge, wherein said sealing member is an elastic member provided by solidification of liquid material in a groove formed in the connection surface.

13. A cartridge according to claim 12, wherein said sealing member is mounted in place by injecting two-part liquid urethane rubber.

14. A cartridge according to claim 12, wherein said sealing member is composed of foamed polyurethane.

15. A cartridge according to claim 12, wherein said sealing member is composed of foamed silicon.

16. A cartridge according to claim 12, wherein said sealing member is mounted around a developing sleeve of said developing accommodating means.

17. A cartridge according to claim 12, wherein said sealing member is mounted around a cleaning device.

18. A cartridge according to claim 12, wherein said developer accommodating means accommodate toner.

19. A cartridge according to claim 12, wherein said developer accommodating means accommodates residual toner.

20. A cartridge according to claim 12, wherein process means includes a cleaning device in the form of a cleaning blade actable on a photosensitive drum.

21. A cartridge according to claim 12, wherein said process means is in the form of a developing device comprising a developing sleeve actable on a photosensitive drum.

22. A cartridge according to claim 12, wherein said process means is a charger.

23. A cartridge according to claim 12, wherein said sealing member seals between opposite ends of a developing sleeve and a toner container for containing toner.

24. A cartridge according to claim 12, wherein said sealing member seals opposite ends of a photosensitive drum and a residual toner accommodator for accommodating toner removed from the photosensitive drum by a cleaning device.

25. A cartridge according to claim 12, wherein said process cartridge further comprises, integrally therewith; a charger; a developing device; a cleaning device; and an electrophotographic photosensitive member, and wherein said process cartridge is detachably mountable to a main assembly of the image forming apparatus.

26. A cartridge according to claim 12, wherein said sealing member is provided by injecting liquid material which solidifies into an elastomer.

27. A cartridge according to claim 12, wherein said process means is disposed around an electrophotographic photosensitive member and is actable on the electrophotographic photosensitive member.

28. A cartridge according to claim 12, wherein said developer accommodating means is a toner accommodator for accommodating toner used for development, and said toner accommodator includes a developing container and a toner accommodating portion.

29. A cartridge according to claim 12, wherein said developer accommodating means includes a residual toner accommodator for accommodating residual toner, and wherein said residual toner accomodator includes a cleaning container and a frame.

30. A cartridge according to claim 12, wherein said sealing member is provided by injecting and foaming a foaming material through a nozzle into a groove formed in the process cartridge.

* * * * *

UNITED STATES PATENT AND TRADEMARK OFFICE

CERTIFICATE OF CORRECTION

PATENT NO. : 5,208,634 Page 1 of 2

DATED : May 4, 1993

INVENTOR(S) : ISAO IKEMOTO, ET AL.

It is certified that error appears in the above-indentified patent and that said Letters Patent is hereby corrected as shown below: On the Title page, item [63],

References Cited:

OTHER PUBLICATIONS

Line 4, "Buckely, Patent" should read --Buckley et al., page 2965, February 1974. ¶ Patent--.

Sheet 11

Fig. 14, "STIRREP" should read --STIRRER--

COLUMN 1

Line 32, "covers" should read --cover--.
Line 46, "holder 3a" should read --holder 30a--.
Line 48, "moltplane" should read --Moltopren--.
Line 52, "moltplane" should read --Moltopren--.

COLUMN 2

Line 51, "positions 43" should read --portions 43'--.

COLUMN 3

Line 38, "detachable" should read --detachably--.

COLUMN 5

Line 16, "sleeve 4" should read --device 4--.
Line 25, "structure 42" should read --structure 43--.
Line 40, "fuse" should read --fuses--
Line 41, "member" should read --material--.
Line 66, "member" should read --material--.

UNITED STATES PATENT AND TRADEMARK OFFICE

CERTIFICATE OF CORRECTION

PATENT NO. : 5,208,634

DATED : May 4, 1993

INVENTOR(S) : ISAO IKEMOTO, ET AL.

It is certified that error appears in the above-indentified patent and that said Letters Patent is hereby corrected as shown below:

COLUMN 7

Line 12, "foaming" should read --forming--.
Line 56, "as a" should read --as to a--.

COLUMN 8

Line 44, "to" should be deleted.
Line 68, "inject" should read --injects--.

Signed and Sealed this

Twenty-sixth Day of April, 1994

*Attest:*

*Attesting Officer*

BRUCE LEHMAN

*Commissioner of Patents and Trademarks*